US005108130A

United States Patent [19]

Hansen

[11] Patent Number: 5,108,130

[45] Date of Patent: Apr. 28, 1992

[54] BOOK BRACE

[76] Inventor: Robert S. Hansen, P.O. Box 2238, Rohnert Park, Calif. 94928

[21] Appl. No.: 510,956

[22] Filed: Apr. 19, 1990

[51] Int. Cl.[5] ..... B42D 3/18

[52] U.S. Cl. ..... 281/18; 281/15.1; 281/20

[58] Field of Search ..... 281/15.1, 18, 20; 24/384, 389, 487, 587

[56] References Cited

U.S. PATENT DOCUMENTS

| | | | |
|---|---|---|---|
| 4,083,582 | 4/1978 | Villafana | 281/20 |
| 4,858,286 | 8/1989 | Siegel | 24/587 |
| 4,898,492 | 2/1990 | Janowski | 24/587 X |
| 4,932,679 | 6/1990 | Mayer et al. | 281/18 |
| 4,997,207 | 3/1991 | Feldman | 281/18 |

FOREIGN PATENT DOCUMENTS

| | | | |
|---|---|---|---|
| 706084 | 3/1965 | Canada | 24/587 |
| 3106820 | 9/1982 | Fed. Rep. of Germany | 281/20 |

*Primary Examiner*—Paul A. Bell

*Attorney, Agent, or Firm*—Flehr, Hohbach, Test, Albritton & Herbert

[57] ABSTRACT

Brace for supporting a soft-covered book so that it can stand in an upright position without collapsing. The brace includes a pair of support flaps which are attached to the covers of the book along the edges opposite the binding and are adapted to overlie each other when the book is closed. A fastener releasably secures the support flaps together to hold the covers in a spaced parallel relation when the book is closed.

14 Claims, 2 Drawing Sheets

BOOK BRACE

This invention pertains generally to books, and more particularly to a brace for supporting a soft-covered book in an upright position.

Soft-sided books, such as telephone books and the like, are relatively rigid along the edges on which they are bound but are otherwise relatively flexible. When such books are stood in an upright position, the portions of the covers away from the binding tend to buckle and collapse due to the weight of the book. This problem is particularly severe when the pages of the book are relatively thin, as they are, for example, in a telephone book.

It is in general an object of the invention to provide a new and improved brace for supporting a soft-covered book in an upright position.

Another object of the invention is to provide a book brace of the above character which is economical and easy to use.

These and other objects are achieved in accordance with the invention by providing a book brace having a pair of support flaps attached to the covers along the edges of the covers opposite the bound edge and adapted to overlie each other when the book is closed, and means for releasably securing the support flaps together to hold the covers in a spaced parallel relation when the book is closed so that the book can stand by itself in an upright position without collapsing.

Figure 1:
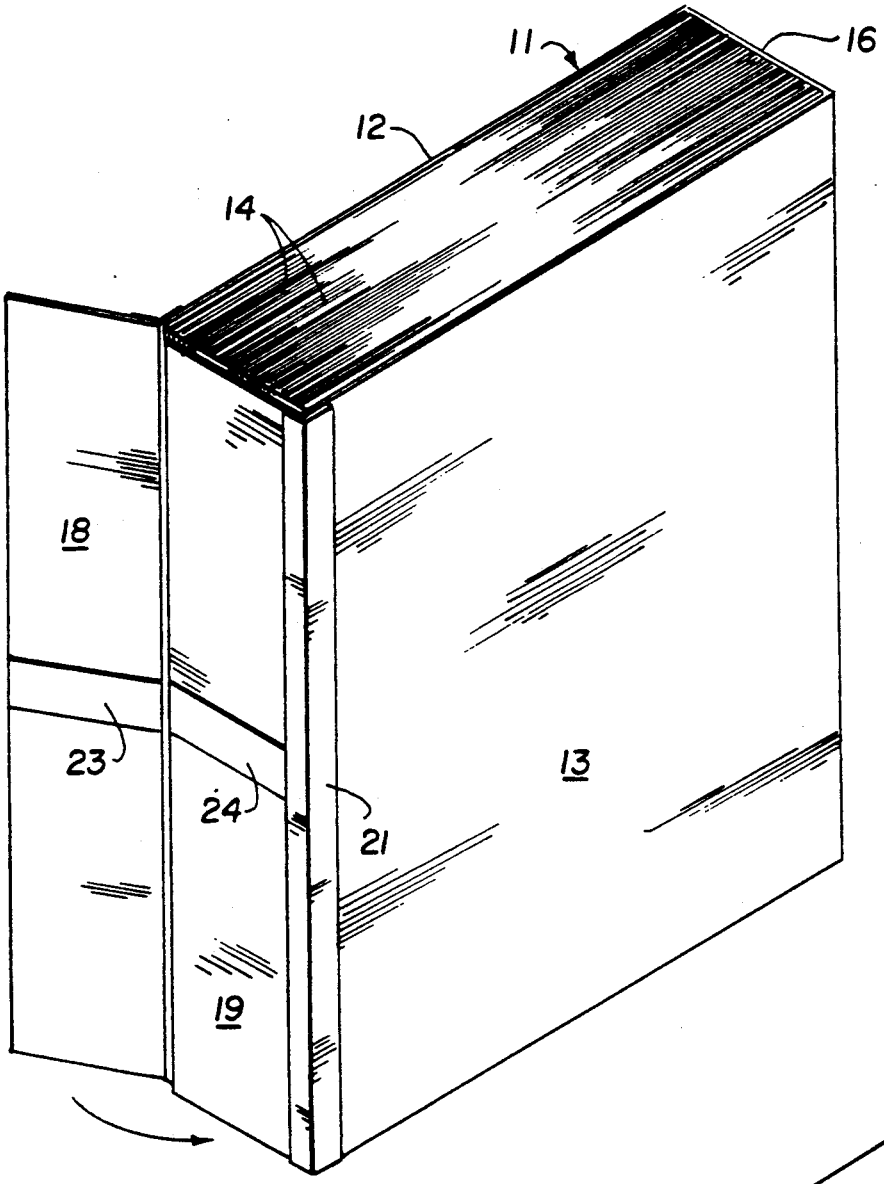
FIG. 1 is an isometric view of a book with one embodiment of a brace in accordance with the invention.

In the drawings, the invention is illustrated in connection with a soft-sided book 11, such as a telephone book or the like, which has a front cover 12, a back cover 13, and a plurality of pages 14. The covers and the pages are bound together along one edge by a binding 16. Although typically somewhat thicker and less flexible than the pages, the covers are still not rigid enough to support the book in an upright position. In the embodiment illustrated, the covers are formed from a single sheet of stock which extends around the bound edge of the book, but they can also be formed as separate sheets.

A pair of support flaps 18, 19 are attached to the front and back covers, respectively, to support the book in an upright position when it is closed. Each of these flaps is generally rectangular in shape, with a length slightly less than the height of the book and a width slightly less than the thickness of the book. The support flaps are attached to the covers along the edges opposite the binding, and when the book is closed, the flaps overlie each other along the side edge of the book opposite the binding. The support flaps can be made out of any suitable material such as a relatively thin plastic sheet, e.g. mylar. The flaps can be either rigid or flexible as long as they have sufficient stiffness to hold the edges where they are attached to the covers straight when the book is closed and the flaps are in their overlapping position.

The support flaps are hingedly attached to the covers, and they can be laid flat or folded back against the covers when the book is opened. In the embodiment illustrated, the flaps are attached to the covers by an adhesive tape 21 which provides the hinging action as well as securing the flaps to the covers. Alternatively, the flaps can be bonded directly to the covers by an adhesive, and the flaps can be scored or formed with lines of reduced thickness to provide the hinging action. With some materials, the flaps themselves may be flexible enough to provide the desired hinging action.

Figure 2:
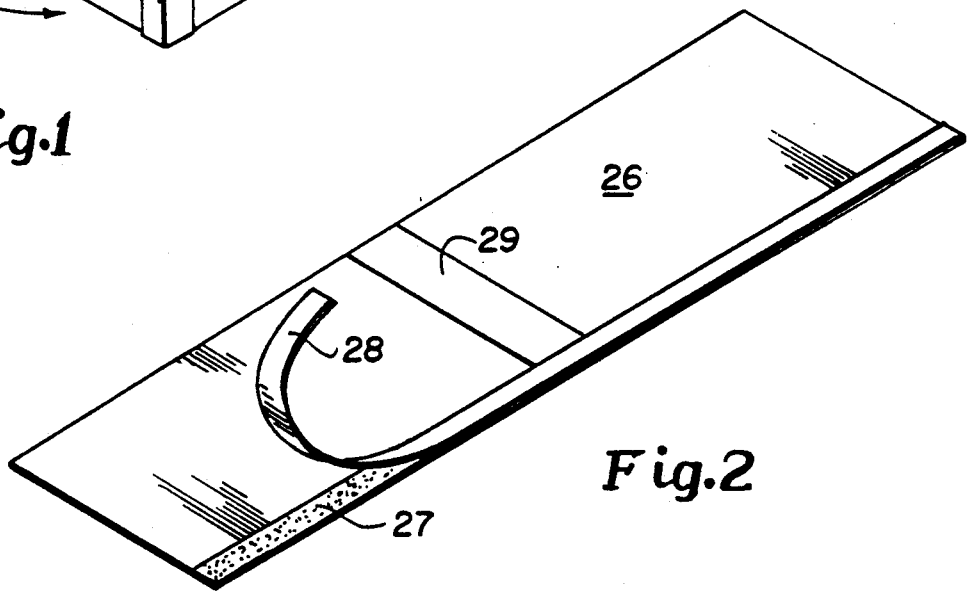
FIG. 2 is an isometric view of one embodiment of sheet of stock from which a support flap for use in the book brace of FIG. 1 can be cut.

Means is provided for releasably securing the flaps together in their overlapping position when the book is closed. In the embodiment illustrated, this means comprises a hook and pile fastener of the type commonly available under the Velcro trademark. This fastener has interlocking sections 23, 24 which are affixed to the flaps in aligned positions for mating engagement when the book is closed and the flaps are in the overlapping position. Any other suitable type of fastener can be employed, if desired. Additional fasteners can also employed, and may be helpful in providing a more rigid structure when relatively flexible support flaps, which might otherwise tend to curl, are employed. With stiffer flaps, a single fastener is generally sufficient to retain the flaps in the overlapping position with the edges of the cover held straight. Instead of extending horizontally as shown in FIGS. 1 and 2, the fastener strips can extend vertically, and in one presently preferred embodiment, they extend substantially the entire length or height of the book.

The brace is conveniently marketed in the form of sheets which can be cut by the customer to make support flaps for books of different sizes. An example of such a sheet is shown in FIG. 2. This sheet, designated by the reference numeral 26, is generally rectangular and has a strip of adhesive tape 27 along one edge thereof. A portion of the tape projects beyond the edge of the sheet, and the adhesive on this portion of the tape is covered by a removable protective strip 28. A strip of hook and pile fastener 29 extends across the central portion of the sheet. If desired, guide lines can be imprinted on the sheet to assist in cutting the sheet to the proper size.

A support flap is conveniently cut from sheet 26 and applied to a book as follows. The sheet is cut to the desired size by trimming both ends of the sheet so the fastener strip remains in a central position and by trimming the edge of the sheet opposite the tape. The trimmed sheet, or flap, is placed between one of the book's covers and the adjacent page, with the taped edge of the sheet aligned with the edge of the cover opposite the binding and the adhesive side of the tape facing the cover. The tape is then folded over the outer side of the cover, and the protective strip is removed from the adhesive. The exposed adhesive is then pressed against the outer side of the cover to bond the tape to the cover. The flap is then repositioned outside the book, with the tape serving as a hinge. A second flap is prepared and attached to the other cover in a similar manner, with the mating fastener on that flap being positioned for engagement with the fastener on the first flap. Tucking the flaps inside the covers during installation assures proper alignment of the flaps and the covers, and it also helps to hold the covers in the proper position while the tape is applied. Alternatively, if desired, the sheets can be attached to the covers in their untrimmed form, then cut to size after they are attached.

Once the brace has been installed and the support flaps have been secured together by the fastener, the book can stand by itself without collapsing. To use the book, it is only necessary to disengage the fastener, e.g. by pulling the outer flap away from the inner one. When the book is opened, the hinged flaps will swing out of the way of the pages by themselves. The book is closed in the normal manner, and the outer flap is pressed against the inner one to engage the fastener.

Figure 3:
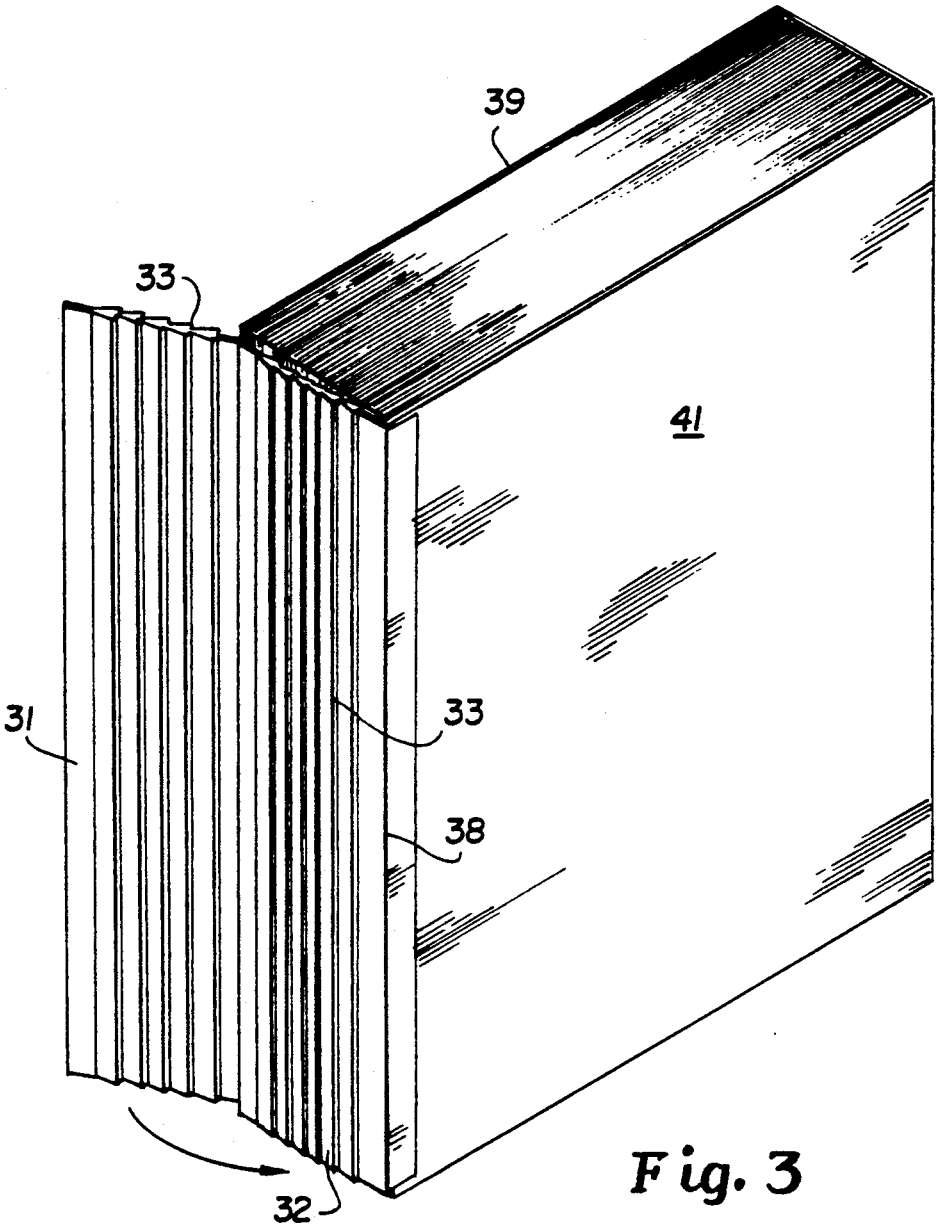
FIG. 3 is a fragmentary isometric view of a book with another embodiment of a brace in accordance with the invention.
Figure 4:
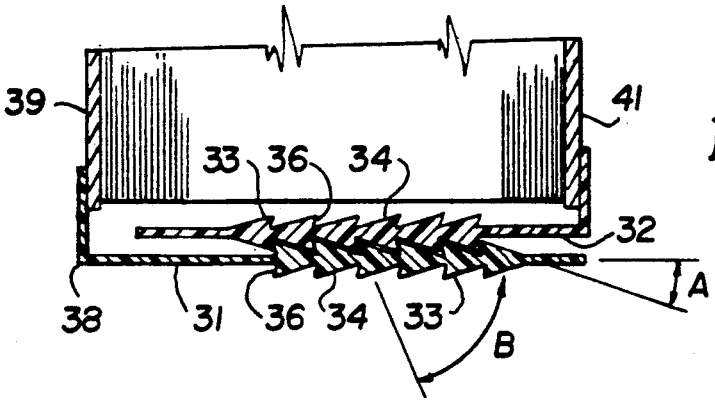
FIG. 4 is a cross-sectional view taken along line 4—4 in FIG. 3, showing the two support flaps in the interlocked or closed position.

In the embodiment of FIGS. 3–4, the support flaps 31, 32 have a plurality of elongated ribs or teeth 33 which extend vertically and interlock to hold the flaps in the closed position. As best seen in FIG. 4, each of the teeth has a side face surface 34 which is inclined at an angle A on the order of 30 degrees relative to the plane of the flap and a rear face 36 which is inclined at an angle B of somewhat less than 90 degrees relative to the plane of the flap. The teeth on the two flaps face in opposite directions so that when the flaps are pressed together, the teeth intermesh, with the rear faces hooking together and the side faces being positioned beside each other.

Flaps 31, 32 are fabricated of a suitable plastic material, with integral hinges 38, and are attached to the covers 39, 41 of a book by an adhesive. The flaps can be made by any suitable process such as injection molding or extrusion. In order for the hinges to function properly and withstand repeated use, the molecules in the plastic material should run across the hinges rather than along them. This can be accomplished by forming the hinges as part of an injection molding process or by reheating the plastic material and pressing on it along the hinge lines.

Installation and use of the book brace of FIGS. 3–4 is similar to that of the previous embodiment, and as in the case of the previous embodiment, the material for making the flaps can be conveniently manufactured and marketed in the form of strips or sheets which can be cut to the appropriate size for a given book.

It is apparent from the foregoing that a new and improved book brace has been provided. While only certain presently preferred embodiments have been described in detail, as will be apparent to those familiar with the are, certain changes and modifications can be made without departing from the scope of the invention as defined by the following claims.

I claim:

1. A brace for use with a book having flexible covers and pages bound together along one edge thereof, comprising a pair of generally planar support flaps, means for attaching the support flaps to the covers along the edges of the covers opposite the bound edge, and means for releasably securing the support flaps together to hold the book in a closed position, the support flaps having sufficient stiffness to hold the edges of the covers to which they are attached straight and rigid when the book is closed and the flaps are secured together so that the book can stand by itself in an upright position without collapsing.

2. The book brace of claim 1 wherein each of the support flaps has a length corresponding to the length of the covers and a width corresponding to the thickness of the book.

3. The book brace of claim 1 wherein the support flaps and the means for attaching the flaps to the covers include means for providing a hinged connection between the flaps and the covers.

4. The book brace of claim 1 wherein the means for releasably securing the support flaps together comprises a hook and pile fastener.

5. In combination: a book having flexible covers and pages bound together along one edge thereof, a pair of generally planar support flaps attached to the covers along the edges of the covers opposite the bound edge and adapted to overlie each other when the book is closed, and means for releasably securing the support flaps together when the book is closed, the support flaps having sufficient stiffness to hold the edges of the covers to which they are attached stiff and straight when the flaps are secured together so that the book can stand by itself in an upright position without collapsing.

6. The combination of claim 5 wherein each of the support flaps has a length corresponding to the length of the covers and a width corresponding to the thickness of the book.

7. The combination of claim 5 wherein the support flaps are hingedly attached to the covers of the book.

8. The combination of claim 5 wherein the means for releasably securing the support flaps together comprises a hook and pile fastener.

9. A brace for use with a soft-covered book which is bound along one edge to prevent the book from collapsing when stood in an upright position: a pair of generally rectangular support flaps having an adhesive along one edge thereof for attachment to the edges of the covers opposite the bound edge, and means carried by the support flaps for securing the flaps together in an overlapping relationship to prevent movement of the covers relative to each other when the book is closed, the support flaps having sufficient stiffness to hold the edges of the covers to which they are attached stiff and straight when the flaps are secured together.

10. The combination of claim 9 wherein the means for securing the flaps together comprises a hook and pile fastener.

11. The combination of claim 9 including a removable protective strip covering the adhesive on the support flaps.

12. A brace for use with a book having flexible covers and pages bound together along one edge thereof, comprising a pair of elongated support flaps adapted to be attached to the covers along the edges of the covers opposite the bound edge and having confronting faces which overlie each other when the book is closed, and a plurality of elongated teeth positioned side-by-side in spaced parallel relationship on the confronting faces of the two flaps and extending lengthwise of the flaps for interlocking engagement to secure the flaps together and hold the covers in a spaced parallel relationship when the book is closed so that the book can stand by itself in an upright position without collapsing.

13. In combination: a book having flexible covers and pages bound together along one edge thereof, a pair of elongated support flaps attached to the covers along the edges of the covers opposite the bound edge and having confronting faces which overlie each other when the book is closed, and a plurality of elongated teeth positioned side-by-side in spaced parallel relationship on the confronting faces of the two flaps and extending lengthwise of the flaps for interlocking engagement to secure the flaps together and hold the covers in a spaced parallel relationship when the book is closed so that the book can stand by itself in an upright position without collapsing.

14. A brace for use with a soft-cover book which is bound along one edge to prevent the book from collapsing when stood in an upright position, comprising a pair of generally rectangular support flaps having an adhesive along one edge thereof for attachment to the edges of the covers opposite the bound edge and having confronting faces which overlie each other when the book is closed, and a plurality of elongated teeth positioned side-by-side in spaced parallel relationship on the confronting faces of the two flaps and extending lengthwise of the flaps for interlocking engagement to secure the flaps together to prevent movement of the covers relative to each other when the book is closed.

* * * * *